US005249461A

United States Patent [19]

Ponder et al.

[11] Patent Number: 5,249,461

[45] Date of Patent: Oct. 5, 1993

[54] METHOD FOR TESTING PERFORATING AND TESTING AN OPEN WELLBORE

[75] Inventors: Gaylon D. Ponder; Bryan W. McDonald, both of Roswell, N. Mex.; Robert A. Parrott, Houston, Tex.

[73] Assignee: Schlumberger Technology Corporation, Houston, Tex.

[21] Appl. No.: 824,979

[22] Filed: Jan. 24, 1992

[51] Int. Cl.[5] ..... E21B 43/11; E21B 43/12; E21B 47/10; E21B 49/08

[52] U.S. Cl. ..... 73/155; 166/250; 166/264

[58] Field of Search ..... 73/155; 166/250, 264

[56] References Cited

U.S. PATENT DOCUMENTS

| | | | |
|---|---|---|---|
| Re. 32,755 | 9/1988 | Vann . | |
| 3,600,933 | 8/1971 | Johnston et al. | 73/570 |
| 3,977,394 | 8/1976 | Jones et al. | 73/23.3 |
| 3,986,385 | 10/1976 | Johnston et al. | 73/570 |
| 4,545,248 | 10/1985 | Kitada et al. | 73/597 |
| 4,797,821 | 1/1989 | Petak et al. | 73/155 |
| 4,832,121 | 5/1989 | Anderson | 73/155 |
| 4,846,294 | 7/1989 | Sato | 73/862.626 |
| 4,893,505 | 1/1990 | Marsden et al. | 73/155 |
| 4,976,142 | 12/1990 | Perales | 73/155 |
| 5,056,595 | 10/1991 | Desbrandes | 73/155 |
| 5,092,167 | 3/1992 | Finley et al. | 73/155 |

OTHER PUBLICATIONS

Tyler, T. N., Metzger, R. R., and Twyford, L. R.: "Analysis and Treatment of Formation Damage at Prudhoe Bay, Alaska," J. Pet. Tech. (Jan. 1985) pp. 1010–1018.

*Primary Examiner*—Hezron E. Williams
*Assistant Examiner*—George M. Dombroske
*Attorney, Agent, or Firm*—Henry N. Garrana; John H. Bouchard

[57] ABSTRACT

A new method and apparatus for performing a drill stem test in an open (not cased) borehole are disclosed. When the borehole is initially drilled, the drilling process induces a skin damage near the external surface of the open (not cased) wellbore. It is necessary and desirable to bypass, reduce, or eliminate the skin damage in order to provide a free or natural flow of well fluid from the reservoir in the formation into the wellbore. However, in order to determine the degree of skin damage which exists near the external surface of the wellbore, reservoir parameters such as pressures, temperature and flowrates of the formation fluid flowing from the reservoir into the wellbore is first measured in the presence of the skin damage. The skin damage is then bypassed, removed, eliminated, or reduced by, for example, perforating the external surface of the wellbore. When the wellbore surface has been perforated, the reservoir parameters such as pressures, temperature and flowrates of the formation fluid flowing from the perforated holes into the wellbore are re-measured thereby determining the true formation reservoir parameters such as pressures, temperature and flowrates of the formation well fluid in the reservoir. The reservoir parameters may be re-measured simultaneously with bypassing or reducing the skin damage, or the reservoir parameters may be re-measured only after the skin damage has been bypassed or reduced.

15 Claims, 1 Drawing Sheet

METHOD FOR TESTING PERFORATING AND TESTING AN OPEN WELLBORE

BACKGROUND OF THE INVENTION

The subject matter of the present invention relates to a process and apparatus for testing, perforating, and testing an open (not cased) formation traversed by a wellbore, the perforation being required in order to penetrate a low permeability or lowered permeability and/or porosity zone which exists in the region of the formation immediately surrounding the wellbore.

When a wellbore is being drilled, a reservoir filled with oil, natural gas or other valuable fluid may be discovered in the earth's formation. During the drilling, a drilling fluid circulates through the wellbore. If the reservoir is permeable, the formation fluid in the reservoir will enter the wellbore when the reservoir's formation pressure is greater than the hydrostatic pressure of the drilling fluid. In order to prevent blowouts from this effect, the drilling fluid circulates at a pressure which is greater than the particular formation pressure of the formation fluid. As a result, a portion of the drilling fluid, called filtrate, enters the formation traversed by the wellbore and a mudcake forms on the external surface of the wellbore. The mudcake tends to slow the rate at which the filtrate enters the formation; nevertheless, the filtrate continues to enter the formation. When the filtrate enters a formation which contains dry natural gas, the filtrate adheres to the surface of sand grains present near the external surface of the wellbore. Although the sand grains were previously dry, the sand grains are now wet thereby reducing the effective porosity and/or permeability of the formation near the external surface of the wellbore. In another situation, if an oil or gas bearing formation contains a certain amount of shale, when the shale near the external surface of the wellbore becomes wet in the presence of the filtrate, it absorbs the filtrate and expands, thereby reducing the effective porosity and/or permeability of the formation near the external surface of the wellbore. In another situation, fine solid particles created by the drilling process may migrate into the porous material near the surface of the wellbore and reduce the porosity and permeability of such material very near the external surface of the wellbore. When drilling is complete, a drill stem test often commences. During the drill stem test, the pressure existing within the wellbore is less than the pressure of the formation fluid in the reservoir (an underbalanced condition) and formation fluid flows into the drill string. The reduced permeability and/or effective porosity near the external surface of the wellbore tends to restrict or block the flow of the formation fluid from the reservoir into the wellbore (a condition called "skin damage"); as a result, the production capacity of the reservoir cannot be accurately achieved or measured, nor can an adequate sample of the produced fluid be obtained. In this condition, it would be desirable to first eliminate or reduce the skin damage which exists near the external surface of the wellbore in order that a free or natural flow of formation fluid may be produced from the reservoir into the wellbore, and second that the reservoir characteristics may be accurately measured during a drill stem test.

One prior art method of eliminating or reducing the skin damage is to circulate or spot a fluid, such as acid, in the wellbore in order to dissolve the mud or other materials which exist in the formation near the external surface of the wellbore. Another prior art method of eliminating the skin damage is to perforate the formation during the drill stem test. Therefore, one prior art method of performing a drill stem test comprises the steps of eliminating the skin damage by perforating the formation at the moment the test begins while conducting the drill stem test. However, when this method is used, one has no knowledge of the pressure, temperature and flowrate of formation fluids which flow from the reservoir into the wellbore in the presence of the skin damage on the external surface of the wellbore; in addition, when this method is used, the integrity of the packer seat cannot be tested before perforating; and, if little or no skin damage exists, the zone cannot be tested without incurring additional expense, or other possible complications, related to the perforating.

SUMMARY OF THE INVENTION

Accordingly, it is a primary object of the present invention to provide a new method or process for performing a drill stem test in an open (not cased) wellbore, which new method involves first measuring reservoir parameters, such as the pressure, temperature and flowrate, of formation fluid flowing from the reservoir, eliminating, reducing, or bypassing the skin damage which exists near the external surface of the wellbore, and re-measuring the reservoir parameters of the formation fluid flowing from the reservoir.

It is a further object of the present invention to provide the new method for performing a drill stem test in an open wellbore, which new method further involves first measuring the pressures, temperature and flowrates of the formation fluid flowing from the reservoir when the skin damage exists near the external surface of the wellbore, bypassing, reducing, or eliminating the skin damage, and subsequently re-measuring the pressures, temperature and flowrates of the formation fluid flowing from the reservoir after the skin has been bypassed, reduced, or eliminated in order to determine the true production characteristics of the reservoir.

It is a further object of the present invention to provide the new method for performing a drill stem test in an open wellbore, which new method further involves first measuring the pressures, temperature and flowrates of the formation fluid flowing from the reservoir when the skin damage exists near the external surface of the wellbore, bypassing, reducing, or eliminating the skin damage by perforating the external surface of the wellbore using a perforating gun, and subsequently re-measuring the pressures, temperature and flowrates of the formation fluid flowing from the reservoir after the skin damage has been bypassed, reduced, or eliminated in order to determine the true production characteristics of the reservoir.

It is a further object of the present invention to provide the new method for performing a drill stem test in an open wellbore, which new method further involves first measuring the pressures, temperature and flowrates of the formation fluid flowing from the reservoir into the wellbore when the skin damage exists near the external surface of the wellbore, and secondly bypassing, reducing, or eliminating the skin damage while substantially simultaneously re-measuring the pressures, temperature and flowrates of the formation fluid flowing from the reservoir into the wellbore during reduction or elimination of the skin damage thereby determining the true production characteristics of the reservoir.

It is a further object of the present invention to provide the new method for performing a drill stem test in an open wellbore, which new method further involves first measuring the pressures, temperature and flowrates of the formation fluid flowing from the reservoir into the wellbore when the skin damage exists near the external surface of the wellbore, and secondly bypassing, reducing, or eliminating the skin damage by perforating the external surface of the wellbore while substantially simultaneously re-measuring the pressures, temperature and flowrates of the formation fluid flowing from the reservoir into the wellbore during the perforation of the of the wellbore thereby determining the true production characteristics of the reservoir.

In accordance with these and other objects of the present invention, a new method or process for performing a drill stem test in an open (not cased) borehole is disclosed. When the borehole is initially drilled, the drilling fluid induces a skin damage near the external surface of the open (not cased) wellbore. It is necessary and desirable to eliminate or reduce the skin damage in order to provide a free flow of formation fluid from the reservoir into the wellbore. However, in order to determine the degree of skin damage which exists near the external surface of the wellbore, the pressures, temperature and flowrates of the formation fluid flowing from the reservoir into the wellbore is first measured in the presence of the skin damage. The skin damage is then removed, eliminated, reduced or bypassed by, for example, perforating the external surface of the wellbore. The reservoir is retested through the perforations which bypass the skin damage thereby determining the true reservoir characteristics. The reservoir may be retested after the skin damage has been removed by, for example, perforation of the wellbore. Alternatively, the reservoir may be retested substantially simultaneously with removal of the skin damage by perforation of the wellbore.

The method of the present invention may also assist in determining the effect of increasing wellbore radius in a naturally low porosity and/or low permeability reservoir when no skin damage exists, as might be the case in a well drilled underbalanced, since any increase in flowrates of fluid production during a drill stem test after, for instance, perforating may encourage the well operator to increase wellbore radius further by, for instance, hydraulic fracture treatment during completion of the well.

Further scope of applicability of the present invention will become apparent from the detailed description presented hereinafter. It should be understood, however, that the detailed description and the specific examples, while representing a preferred embodiment of the present invention, are given by way of illustration only, since various changes and modifications within the spirit and scope of the invention will become obvious to one skilled in the art from a reading of the following detailed description.

BRIEF DESCRIPTION OF THE DRAWINGS

A full understanding of the present invention will be obtained from the detailed description of the preferred embodiment presented hereinbelow, and the accompanying drawings, which are given by way of illustration only and are not intended to be limitative of the present invention, and wherein.

DETAILED DESCRIPTION OF THE PREFERRED EMBODIMENT

Figure 1:
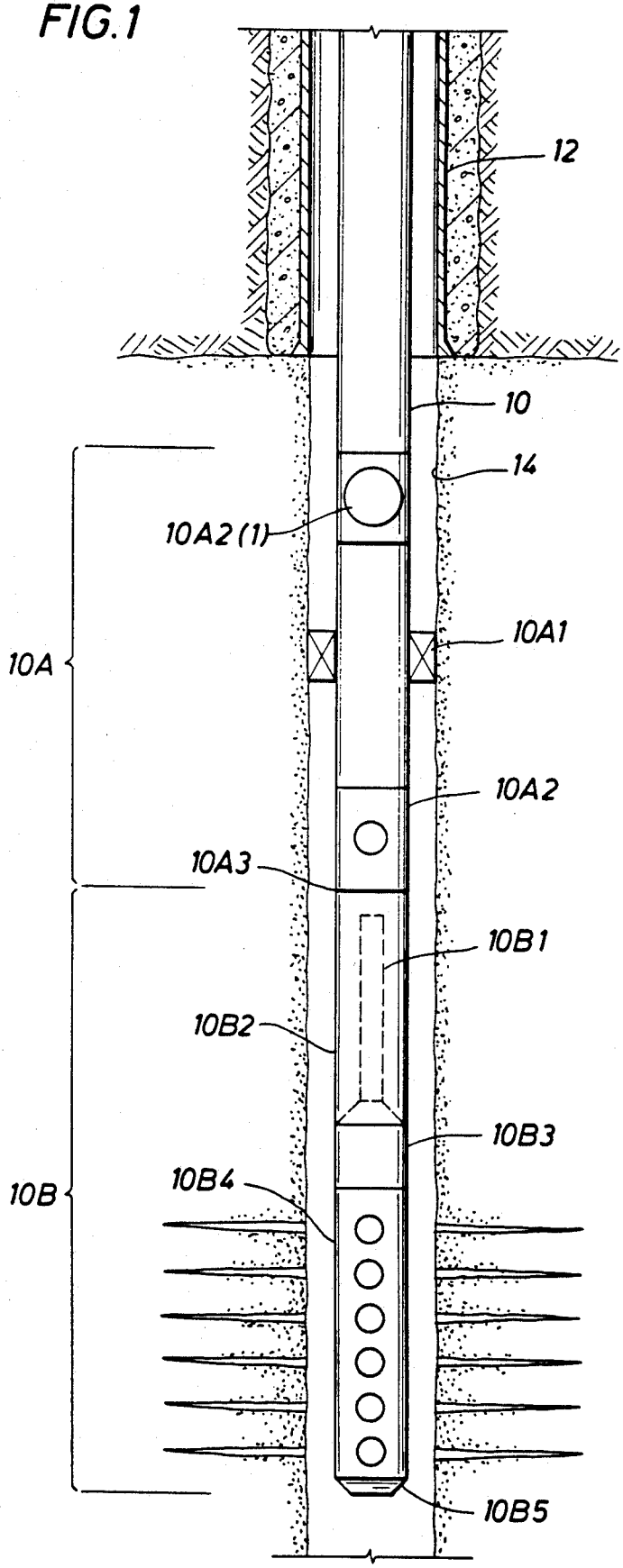
FIG. 1 illustrates a drill stem test string including a perforating gun in an open, not cased, wellbore.

Referring to FIG. 1, two new drill stem test methods are adapted for use in conjunction with the drill stem test apparatus of FIG. 1, which apparatus is adapted to be disposed in an open borehole. The drill stem test apparatus of FIG. 1 includes conventional drill stem test devices including a packer and a valve or circulating sub; however, it also includes a perforating gun. The perforating gun is disposed in an open, not cased, wellbore.

In FIG. 1, a tubing 10 is disposed in a wellbore. The wellbore includes a partially cased section enclosed by a casing 12 and an un-cased section 14 which is not enclosed by the casing 12. The un-cased section 14 is referred to as an "open hole" or an "open wellbore" 14. The tubing 10 includes a drill stem test string section 10A and a perforating gun section 10B. The drill stem test string section 10A includes a compression set packer 10A1; a circulating sub 10A2 which includes a valve 10A2(1), disposed above the packer and normally on top of the 'jars', that is adapted to open and close; and a cross over 10A3. The perforating gun section 10B includes a firing head 10B1; a compression spacer 10B2; a compression adaptor 10B3; a perforating gun section 10B4 which includes a plurality of shaped charges; and a bottom nose section 10B5 which is adapted to contact a bottom of the wellbore, the bottom nose section 10B5 being adapted to screw in to drill collars which set on the wellbore bottom, the drill collars being designed to space out the interval so that the guns are over the desired zone. The compression spacer 10B2 is designed to keep the compressive weight off the firing head assembly and on the spacer which houses the firing head. The compression adaptor 10B3 functions to absorb any compressive weight placed on the perforating gun section 10B when the compression set packer 10A1 is being set and to prevent the perforating gun 10B4 from bending with respect to the compression spacer 10B2.

A functional description of the operation of the apparatus of FIG. 1 will be set forth in the following paragraphs.

As noted in the background section of this specification, when a wellbore is being drilled, a reservoir filled with oil, natural gas or other valuable fluid may be discovered in the earth's formation. During the drilling, a drilling fluid circulates through the wellbore. If the reservoir is permeable, the formation fluid in the reservoir will enter the wellbore when the reservoir's formation pressure is greater than the hydrostatic pressure of the drilling fluid. In order to prevent blowouts from this effect, the drilling fluid circulates at a pressure which is greater than the particular formation pressure of the formation fluid. As a result, a portion of the drilling fluid, called filtrate, enters the formation traversed by the wellbore and a mudcake forms on the external surface of the wellbore. The mudcake tends to slow the rate at which the filtrate enters the formation; nevertheless, the filtrate continues to enter the formation. When the filtrate enters a formation which contains dry natural gas, the filtrate adheres to the surface of sand grains present near the external surface of the wellbore. Although the sand grains were previously dry, the sand grains are now wet thereby reducing the effective porosity and/or permeability of the formation near the external surface of the wellbore. In another situation, if an oil or gas bearing formation contains a certain amount of shale, when the shale near the external surface of the wellbore becomes wet in the presence of the filtrate, it absorbs the filtrate and expands thereby reducing the effective porosity and/or permeability of the formation near the external surface of the wellbore. In another situation, fine solid particles created by the drilling process may migrate into the porous material near the surface of the wellbore and reduce the porosity and permeability of such material very near the external surface of the wellbore. When drilling is complete, and a drill stem test commences, since the pressure existing within the wellbore is less than the pressure of the formation fluid in the reservoir (an underbalanced condition), formation fluid flows into the drill string. The reduced permeability and/or effective porosity near the external surface of the wellbore tends to restrict or block the flow of the formation fluid from the reservoir into the wellbore (a condition called "skin damage"); as a result, the production capacity of the reservoir cannot be accurately achieved or measured. In this condition, it would be desirable to eliminate or reduce the skin damage which exists near the external surface of the wellbore in order that a free or natural flow of formation fluid may be produced from the reservoir into the wellbore and the reservoir characteristics may be accurately measured during a drill stem test. Accordingly, one method of performing a drill stem test comprises eliminating or reducing the skin damage by first perforating the open wellbore 14 during a drill stem test, that is, by commencing perforation at the moment a drill stem test begins and while conducting the drill stem test; and then measuring the parameters of a formation fluid being produced from the perforated wellbore 14, such as pressure, temperature and flowrate. However, this method fails to first determine the parameters of the formation fluid prior to eliminating or reducing the skin damage (prior to perforating the wellbore 14).

Therefore, in accordance with one embodiment of the present invention, a first improved method or procedure of performing a drill stem test, when using the structure of FIG. 1 in an open, not cased, wellbore, comprises the steps of:

1. before perforating the open hole 14, open the valve 10A2(1) in order to measure the reservoir parameters of the formation fluid, such as pressures, temperature and flowrates, flowing from the formation into the wellbore;
2. close the valve 10A2(1);
3. detonate the perforating gun 10B4; this bypasses or partially bypasses the skin damage region which exists near the external surface of the wellbore and formation fluid starts to flow from the perforated holes in the formation; and
4. after the skin damaged region has been bypassed or reduced by detonation of the perforating gun 10B4, open the valve 10A2(1) again and begin re-measuring the reservoir parameters such as pressures, temperature and flowrates of the formation fluid flowing from the formation into the wellbore via the perforated holes or tunnels in the formation; since the skin damaged region has been bypassed or reduced, formation fluid can flow more freely from the formation, or reservoir, into the wellbore thereby allowing the true reservoir characteristics such as pressures, temperature and flowrates of the formation fluid to be more accurately measured.

Furthermore, in accordance with another embodiment of the present invention, a second improved method or procedure of performing a drill stem test, when using the structure of FIG. 1 in an open, not cased, wellbore, comprises the steps of:

1. before perforating the open hole 14, open the valve 10A2(1) in order to measure the reservoir parameters of the formation fluid, such as pressures, temperature and flowrates, flowing from the formation into the wellbore 14;
2. after the reservoir parameters have been measured, leave the valve 10A2(1) open;
3. while the valve 10A2(1) is still open, detonate the perforating gun 10B4; this bypasses or reduces the skin damaged region which exists near the external surface of the wellbore and further formation fluid starts to flow from the perforated holes in the formation into the wellbore 14; the skin damage has been eliminated, reduced, or bypassed by perforating the external surface of the wellbore; and
4. with the valve 10A2(1) still open, and substantially simultaneously with the perforation of the external surface of the wellbore, begin re-measuring the reservoir parameters, such as pressure, temperature and flowrate, of the formation fluid flowing from the formation into the wellbore 14 via the perforated holes or tunnels in the formation; since the skin damaged region has been bypassed or reduced, formation fluid flows more freely from the formation, or reservoir, into the wellbore 14 thereby allowing the true reservoir characteristics such as pressures, temperature and flowrates of the formation fluid to be more accurately measured.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

We claim:

1. A method of performing a drill stem test in an open borehole, an external surface of said open borehole having a skin damage, comprising the steps of:

measuring a parameter of a well fluid flowing from said external surface of said open borehole in the presence of said skin damage;

bypassing or reducing said skin damage on said external surface of said open borehole, a further well fluid flowing from the external surface; and re-measuring said parameter of the further well fluid flowing from the external surface of the open borehole.

2. The method of claim 1, wherein the bypassing step comprises the step of:

perforating said external surface of the open borehole thereby bypassing or reducing said skin damage, said further well fluid flowing from the perforated external surface of said open borehole.

3. The method of claim 2, wherein said parameter is a pressure.

4. The method of claim 2, wherein said parameter is a temperature.

5. The method of claim 2, wherein said parameter is a flowrate.

6. The method of claim 1, wherein the bypassing step and the re-measuring step are performed substantially simultaneously.

7. The method of claim 6, wherein the bypassing step comprises the step of:

perforating said external surface of the open borehole thereby bypassing or reducing said skin damage, said further well fluid flowing from the perforated external surface of said open borehole.

8. The method of claim 7, wherein said parameter is a pressure.

9. The method of claim 7, wherein said parameter is a temperature.

10. The method of claim 7, wherein said parameter is a flowrate.

11. The method of claim 1, wherein the re-measuring step is performed after completion of the bypassing step.

12. The method of claim 11, wherein the bypassing step comprises the step of:

perforating said external surface of the open borehole thereby bypassing or reducing said skin damage, said further well fluid flowing from the perforated external surface of said open borehole.

13. The method of claim 12, wherein said parameter is a pressure.

14. The method of claim 12, wherein said parameter is a temperature.

15. The method of claim 12, wherein said parameter is a flowrate.

* * * * *